US006585365B1

(12) United States Patent
MacMillan

(10) Patent No.: US 6,585,365 B1
(45) Date of Patent: Jul. 1, 2003

(54) PAPER COATING FOR INK JET PRINTING

(75) Inventor: David Starling MacMillan, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 394 days.

(21) Appl. No.: 09/667,749

(22) Filed: Sep. 21, 2000

Related U.S. Application Data

(63) Continuation-in-part of application No. 09/484,700, filed on Jan. 18, 2000, now Pat. No. 6,528,119.

(51) Int. Cl.[7] ..... B41J 2/01
(52) U.S. Cl. ..... 347/100; 347/101; 347/105
(58) Field of Search ..... 347/100, 96, 101, 347/84, 105, 95; 427/261, 288, 411; 106/31.13, 31.6

(56) References Cited

U.S. PATENT DOCUMENTS

| | | | | |
|---|---|---|---|---|
| 4,382,262 | A | | 5/1983 | Savit |
| 4,446,174 | A | | 5/1984 | Maekawa et al. |
| 4,538,160 | A | | 8/1985 | Uchiyama |
| 4,554,181 | A | | 11/1985 | Cousin et al. |
| 4,694,302 | A | | 9/1987 | Hackleman et al. |
| 4,830,911 | A | | 5/1989 | Kojima et al. |
| 4,943,813 | A | | 7/1990 | Palmer et al. |
| 4,954,395 | A | | 9/1990 | Hasegawa et al. |
| 4,963,189 | A | | 10/1990 | Hindagolla |
| 5,006,862 | A | | 4/1991 | Adamic |
| 5,118,570 | A | | 6/1992 | Malhotra |
| 5,156,675 | A | | 10/1992 | Breton et al. |
| 5,181,045 | A | | 1/1993 | Shields et al. |
| 5,211,747 | A | | 5/1993 | Breton et al. |
| 5,320,668 | A | | 6/1994 | Shields et al. |
| 5,428,383 | A | | 6/1995 | Shields et al. |
| 5,429,860 | A | | 7/1995 | Held et al. |
| 5,439,739 | A | | 8/1995 | Furukawa et al. |
| 5,496,634 | A | | 3/1996 | Ogawa et al. |
| 5,555,008 | A | | 9/1996 | Stoffel et al. |
| 5,580,372 | A | | 12/1996 | Gino et al. |
| 5,623,041 | A | | 4/1997 | Boucher |
| 5,640,187 | A | | 6/1997 | Kashiwazaki et al. |
| 5,645,888 | A | | 7/1997 | Titterington et al. |
| 5,679,143 | A | | 10/1997 | Looman |
| 5,695,820 | A | | 12/1997 | Davis et al. |
| 5,723,179 | A | | 3/1998 | Wong et al. |
| 5,746,818 | A | | 5/1998 | Yatake |
| 5,797,318 | A | | 8/1998 | Taylor et al. |
| 5,837,042 | A | | 11/1998 | Lent et al. |
| 5,882,388 | A | | 3/1999 | Adair et al. |
| 5,919,559 | A | | 7/1999 | Nakano et al. |
| 5,973,025 | A | | 10/1999 | Nigam et al. |
| 5,993,524 | A | | 11/1999 | Nagai et al. |
| 6,086,197 | A | * | 7/2000 | Kubota et al. ..... 347/100 |
| 6,196,674 | B1 | | 3/2001 | Takemoto et al. |

FOREIGN PATENT DOCUMENTS

| | | | | |
|---|---|---|---|---|
| EP | 0581038 | A1 | 2/1994 | |
| EP | 0778321 | A2 | 6/1997 | |
| EP | 0791473 | A2 | 8/1997 | |
| EP | 0812956 | A1 | 12/1997 | |
| EP | 0822094 | A2 | 2/1998 | |
| EP | 0832741 | A2 | 4/1998 | |
| EP | 0858900 | A2 | 8/1998 | |
| EP | 0876914 | A1 | 11/1998 | |
| EP | 0885744 | A1 | 12/1998 | |
| WO | WO 99/64249 | * | 12/1999 | ..... B41M/5/00 |

* cited by examiner

*Primary Examiner*—Raquel Yvette Gordon
*Assistant Examiner*—Manish Shah
(74) *Attorney, Agent, or Firm*—David E. LaRose; Jacqueline M. Daspit

(57) ABSTRACT

The invention provides an improved paper coating system for ink jet printing applications. The system includes an ink jet printer containing an ink jet pen and a paper coating device for coating a print media with an effective amount of coating composition prior to printing thereon. The coating composition preferably includes from about 0.25 to about 20% by weight of a first component selected from the group consisting of polyvalent metal salt and organic acid, a second component consisting of from about 1 to about 20% by weight amine polymer, from about 0.25 to about 2.0% by weight surfactant and from about 25 to about 96% by weight glycol-based solvent having a surface tension ranging from about 25 to below about 45 dynes/cm. Since the coating composition is free from ethylene glycol-based components, the composition is safer to use and less harmful to humans and the environment. The composition has also been found to provide improved ink drying with less bleeding or smearing of image.

38 Claims, No Drawings

PAPER COATING FOR INK JET PRINTING

This application is a continuation-in-part of application Ser. No 09/484,700 filed Jan. 18, 2000 entitled "Paper Coating for Inkjet Printing" now U.S. Pat. No. 6,528,119.

FIELD OF THE INVENTION

The invention relates to improved coatings for paper for ink jet printing applications and in particular, to coatings which enhance ink drying and produce higher quality printed images.

BACKGROUND OF THE INVENTION

Ink jet printing methods utilize printheads having orifices which eject ink droplets onto a print medium. For higher quality, higher resolution printing applications, the orifices of the printheads have been increased in number and their diameter significantly reduced in size. Accordingly, for full color printed images, inks are formulated to include dyes and/or pigments and various carriers and/or solvents which are resistant to drying or otherwise clogging the nozzle holes of the printhead. Such ink formulations, however often adversely affect the properties of the ink deposited on the print medium resulting in longer drying times and/or color mixing or bleeding of the images resulting in poorer quality images.

Various print media may be used for ink jet printing applications depending on the ink formulations. Such media include cellulosic webs, synthetic papers, polymeric films and the like. As advances in ink jet printing have occurred, specialty papers containing exotic coatings have been developed. Such specialty papers are often more expensive than uncoated papers and may contain coatings which are not compatible with the wide variety of ink formulations being used or developed for ink jet printing applications.

Despite the abundance of specialty webs for ink jet printing, cellulosic webs remain the most widely used print media. Cellulosic webs are made by conventional paper making techniques wherein a fibrous pulp is deposited on a wire screen and dried to form a web. Accordingly, the webs contain minute pores or voids between the cellulosic fibers for absorption of liquids therein. The porosity of the webs may be changed by use of specialty coatings such as clays and the like which may change the hydrophilic properties of the webs so that the webs absorb or repel aqueous and/or organic fluids which may be used as carrier fluids in ink formulations.

Ideally, it is desirable for only the carrier fluid of the ink formulation to penetrate into the web thereby depositing colorant on the outer surface of the web. Balancing the properties of the ink formulations so that the formulations are adaptable for use with a wide variety of print media is extremely difficult. It is even more difficult to provide ink formulations which may be used on uncoated or plain paper webs. Accordingly, a need exists for print medium which is adaptable to accept improved dye and/or pigment based ink formulations.

SUMMARY OF THE INVENTION

With regard to the above and other objects and advantages thereof, the invention provides a system for printing with an ink jet printer. The system includes an ink jet printer containing an ink jet pen and a paper coating device for coating a print media with an effective amount of coating composition prior to printing thereon. The coating composition preferably includes from about 0.25 to about 20% by weight of a first component selected from the group consisting of polyvalent metal salt and organic acid, a second component consisting of from about 1 to about 20% by weight amine polymer, from about 0.25 to about 2.0% by weight surfactant and from about 25 to about 96% by weight glycol-based solvent having a surface tension ranging from about 25 to below about 45 dynes/cm.

In another aspect the invention provides a method for improving print resolution of ink jet printed images. The method includes applying a coating composition to a cellulosic web to provide an ink receptive coating thereon and printing on the coated web prior to drying the coating composition. The preferred coating composition contains from about 0.25 to about 20% by weight of a first component selected from the group consisting of polyvalent metal salt and organic acid, a second component consisting of from about 1 to about 20% by weight amine polymer, from about 0.25 to about 2.0% by weight surfactant and from about 25 to about 96% by weight glycol-based solvent having a surface tension ranging from about 25 to below about 45 dynes/cm.

In yet another aspect the invention provides a cellulosic web containing ink and a penetrant promoter coating the coating being applied to the web prior to printing in an amount sufficient to reduce ink bleeding, promote ink drying and/or penetration of ink into the web. The promoter composition includes from about 0.25 to about 20% by weight of a first component selected from the group consisting of polyvalent metal salt and organic acid, a second component consisting of from about 1 to about 20% by weight amine polymer, from about 0.25 to about 2.0% by weight surfactant and from about 25 to about 96% by weight glycol-based solvent having a surface tension ranging from about 25 to about 45 dynes/cm.

The term "bleeding" as used herein refers to the unintended mixing of colors or wicking of ink colorant into the web rather than remaining on the surface of the web. Webs which are highly absorbent of the colorant tend to produce low resolution images because each ink dot tends to spread due to the affinity of the web fibers for the colorants in the ink. If the ink colorant penetrates too far into the web, too much light may be scattered by the interstices of the upper portion of the web resulting in a lower contrast image. Accordingly, it is desirable that only the ink carrier be absorbed into the web while the colorant remains substantially on the surface of the web.

An important advantage of the invention is that the paper coating composition is more environmentally friendly because of the inclusion of a glycol-based solvent having a surface tension ranging from about 25 to below about 45 dynes/cm. Solvents containing ethylene glycol-based solvents having a surface tension of about 45 dynes/cm or higher are less environmentally friendly than the glycol-based solvents according to the invention. An unexpected benefit of the use of glycol-based solvents having a surface tension ranging from about 25 to below about 45 dynes/cm is that paper coating compositions containing such solvents exhibit increased ink drying rates which enable higher print speeds as compared to other paper coating formulations.

DETAILED DESCRIPTION OF THE PREFERRED EMBODIMENTS

Considering the need to provide enhanced drying of ink formulations in order to reduce or eliminate bleeding and/or ink smearing, the invention provides an improved method and composition for promoting drying of inks on plain paper webs. According to the invention, a formulation is provided for coating cellulosic webs, preferably immediately prior to printing, in order to promote ink drying and color fastness. The formulation is preferably an aqueous-based solution containing a fluid component which promotes increased penetration of the ink carrier into the web without promoting significant penetration of the colorant into the web.

A key component of the formulations according to the invention is a polyhydric alcohol selected from the group consisting of glycol-based solvents having a surface tension ranging from about 25 to below about 45 dynes/cm. Preferred glycol-based solvents of the invention include but are not limited to 1,2-propanediol, dipropylene glycol, tripropylene glycol, and mixtures of two or more of the foregoing provided the glycol-based solvents have a surface tension ranging from about 25 to below about 45 dynes/cm. Glycol-based solvents according to the invention, such as 1,2-Propanediol and di-propylene glycol are widely used in soaps and cosmetics and as such are relatively safer than ethylene glycol-based solvents.

The surface tensions of various glycol-based solvents are contained in the following table:

TABLE 1

| Glycol Material | Surface tension in dynes/cm |
|---|---|
| Tripropylene glycol | 34 |
| Dipropylene glycol | 37 |
| Tetraethylene glycol | 45 |
| Triethylene glycol | 47 |
| 1,3-propanediol | 47 |
| Diethylene glycol | 48 |
| Ethylene glycol | 48 |
| Polyethylene glycol 400 | 48 |
| Glycerol | 63 |
| 1,2-propanediol (propylene glycol) | 40 |

As seen in the foregoing table, ethylene glycol-based solvents generally have surface tensions of 45 and above dynes/cm, whereas the glycol-based solvents according to the invention have surface tensions ranging from the low 30 to below 45 dynes/cm.

The amount of glycol-based solvent in the coating formulation preferably ranges from about 25 to about 96 percent by weight of the formulation, preferably from about 25 to about 75 percent by weight and most preferably from about 25 to about 60 percent by weight of the formulation. Particularly preferred glycol-based solvents may be selected from 100 percent by weight 1,2-propanediol and a mixture containing from about 75 to about 100 percent by weight 1,2-propanediol and from about 0 to about 25 percent by weight dipropylene glycol.

Another component of the coating formulation is selected from a polyvalent metal salt and an organic acid. It is preferred that the polyvalent metal salt be substantially soluble in water. The salt preferably contains a polyvalent metal cation and an inorganic or organic anion component. The polyvalent metal cation may be selected from $Ca^{2+}$, $Cu^{2+}$, $Ni^{2+}$, $Mg^{2+}$, $Zn^{2+}$, $Ba^{2+}$, $Al^{3+}$, $Fe^{3+}$ and $Cr^{3+}$. Of the foregoing calcium and magnesium cations are preferred. The anion component of the polyvalent metal salt may selected from a nitrate group, a chlorate group, a carboxylate group and a halogen ion such as $Cl^-$, $I^-$ and $Br^-$. Of the foregoing anions, the chloride ion and acetate group are preferred and the chloride ion is most preferred. A particularly preferred polyvalent metal salt is calcium chloride dihydrate.

The organic acid is preferably a hydroxy acid selected from the group consisting of lactic acid, glycolic acid, citric acid and malic acid. A particularly preferred organic acid for use in the formulation is citric acid. The amount of polyvalent metal salt or organic acid in the coating formulation preferably ranges from about 0.25 to about 20 percent by weight of the formulation.

The coating formulation also preferably contains an amine polymer, preferably a cationic amine polymer. The amine polymer has a number average molecular weight ($MW_N$) ranging from about 2,000 to about 250,000, preferably from about 2,000 to about 10,000 $MW_N$, and most preferably from about 7,500 to about 10,000 $MW_N$. A particularly preferred amine polymer is a cationic amine polymer having the following structure:

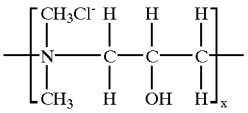

wherein x is an integer ranging from about 15 to about 2000. Such polyamines include cationic polyamines derived from dimethylamine and epichlorohydrin such as the polyamine available from Cytec Industries, Inc. of West Paterson, N.J. under the trade name SUPERFLOC E-567. Other examples of useful amine polymers are available from Cytec Industries, Inc. under the trade name SUPERFLOC C-572 and SUPERFLOC E-4217. The coating formulation preferably contains from about 1 to about 20 percent by weight of the amine polymer.

The coating formulation also preferably contains a surfactant. The surfactant is preferably a non-hydrolyzable copolymer based on polydimethylsiloxane. The general structure of the surfactant is as follows:

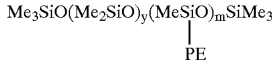

wherein: PE=—$CH_2CH_2CH_2O(EO)_n(PO)_oZ$

Me=a methyl group

EO=an ethyleneoxy group

PO=1,2-propyleneoxy group

Z=H or a lower alkyl radical y=an integer ranging from about 1 to about 10.

m=an integer ranging from about 1 to about 10.

n an integer ranging from about 0 to about 5 and o=an integer ranging from about 0 to about 5.

The surfactant preferably has a number average molecular weight ranging from about 800 to about 5000 $MW_N$, preferably from about 1000 to about 4000 $MW_N$. Representative structures include the following:

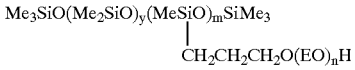

which is available from CK Witco of Greenwich, Conn. under the tradename SILWET L-7604; and

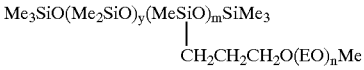

which is available from CK Witco of Greenwich, Conn. under the trade name SILWET L-7607, wherein Me, EO, y, m and n are as defined above. The polysiloxane surfactant is preferably present in the composition in an amount ranging from about 0.25 to about 2.0 parts by weight of the total weight of the formulation.

The balance of the coating composition is water, preferably deionized water. Accordingly, the coating composition may contain from about 0 to about 40 parts by weight water, most preferably from about 15 to about 30 parts by weight water.

A preferred coating formulation according to the invention is contained in the following Table 2:

TABLE 2

| Component | Amount (wt. %) |
|---|---|
| E-4217 (cationic amine polymer from Cytec Industries, Inc.) | 10.0 |
| calcium chloride dihydrate | 7.35 |
| deionized water | 17.4 |
| Glycerol | 5.0 |
| 1,2 propanediol | 42.9 |
| di(propylene glycol) | 14.3 |
| SILWET L-7607 | 1.0 |
| NALCO 8337[1] | 2.0 |
| BES free acid buffering agent[2] | 0.05 |

[1]NALCO 8337 is a corrosion inhibitor available from Nalco Chemical Company, Inc. of Naperville, Illinois.
[2]BES free acid buffering agent is N,N-bis(2-hydroxyethyl)-2-aminoethanesulfonic acid.

In the foregoing formulation, glycerol is added as a relatively high molecular weight humectant to inhibit evaporation of solvent from the formulation so as to enhance the storage stability of the formulation. Other relative high molecular weight humectants may be used in place of or in addition to glycerol. In the alternative, additional 1,2-propanediol may be used to inhibit solvent evaporation. A corrosion inhibitor and buffering agent are also preferably included in the formulation.

Other coating formulations which may be used according to the invention include the formulations listed in the following tables.

TABLE 3

| Component | Amount (wt. %) | Amount (wt. %) |
|---|---|---|
| SUPERFLOC C-567 | 14.5 | 14.5 |
| magnesium acetate tetrahydrate | 25.0 | — |
| calcium acetate hydrate | — | 4.5 |
| deionized water | 11.5 | 19.5 |
| SILWET (L-7600, L-7604 OR L-7607) | 1.0 | 1.0 |
| 1,2 propanediol | 48.0 | 45.5 |
| di(propylene glycol) | — | 15 |

TABLE 4

| Component | Amount (wt. %) | Amount (wt. %) |
|---|---|---|
| Calcium chloride dihydrate | 0.25 | 0.25 |
| SUPERFLOC (C-567, E-4217 or C-572) | 1.0 | 1.0 |

TABLE 4-continued

| Component | Amount (wt. %) | Amount (wt. %) |
|---|---|---|
| deionized water | 72.5 | 72.0 |
| SILWET L-7604 | — | 0.5 |
| 1,2 propanediol | — | 26.25 |
| di(propylene glycol) | 26.25 | — |

In order to make the coating composition the components are preferably mixed by stirring the components together in a suitable container. In order to provide the shortest mixing time, it is preferred to introduce the components to the mixing vessel in the following order (1) water, (2) amine polymer, (3) salt or organic acid, (4) surfactant and (5) glycol-based solvent(s) solvent. The components may be mixed together in any order to provide the same product, however the foregoing order is preferred in order to reduce mixing times.

The coating composition may be applied to a web by a variety of methods including spraying and roll coating, reverse roll coating and the like. It is particularly preferred to apply the coating composition to the web immediately prior to printing so that the web is wet with the coating composition. Accordingly, application of the coating composition to a sheet or web immediately prior to printing using a reverse roll coater is particularly preferred. The coating composition may also be applied to the web by thermal jet ejectors similar to the ejectors used for ink. The amount of coating composition applied to the web preferably ranges from about 0.08 milligrams per square centimeter ($mg/cm^2$) to about 0.25 $mg/cm^2$.

Typically ink is applied to a web in an amount ranging from about 1 to about 2 $mg/cm^2$. Accordingly, it is preferred that the ratio of ink to coating composition on the web range from about 4:1 to about 25:1 parts by weight ink to part by weight coating composition. It is also preferred that the coating composition be applied in close proximity to the printhead of the ink jet printer so that the web remains relatively damp for acceptance of ink ejected from the ink jet printhead. The term "relatively damp" means that the web surface contains sufficient coating composition to enhance the penetration rate of the ink carrier into the web.

The inks which may be used with the coating composition include a wide variety of inks containing pigment or dye colorants. Representative ink formulations include the following as set forth in Tables 5 and 6:

TABLE 5

BLACK INK

| Component | Amount (wt. %) |
|---|---|
| carbon black | 4 |
| Polyethylene glycol (PEG 1000) | 5 |
| 2-pyrrolidone | 5 |
| Thiodiethanol | 5 |
| 1,2-hexanediol | 0.5 |
| Deionized water | 98.5 |

TABLE 6

| | Amount (wt. %) | | |
|---|---|---|---|
| Component | Cyan | Magenta | Yellow |
| DIRECT BLUE 199[1] | 3 | — | — |
| LEXMARK 93A[2] | — | 3 | — |
| Acid yellow 23 | — | — | 3 |

TABLE 6-continued

| Component | Amount (wt. %) | | |
|---|---|---|---|
| | Cyan | Magenta | Yellow |
| 2-pyrrolidone | 7.5 | 7.5 | 7.5 |
| tetraethylene glycol | 12.5 | 12.5 | 12.5 |
| 1,2-hexanediol | 4 | 4 | 4 |
| PROXEL GXL[3] | 0.2 | 0.2 | 0.2 |
| HAMPENE Na3T[4] | 0.1 | 0.1 | 0.1 |
| sodium tetraborate | 0.2 | 0.2 | 0.2 |
| SILWET L-7607[5] | 0.5 | 0.5 | — |
| SILWET L-7600[5] | — | — | 0.5 |
| deionized water | 71.1 | 71.1 | 71.1 |

[1]Direct Blue 199 is a cyan dye available from Avecia, Inc. of Wilmington, Delaware.
[2]LEXMARK 93A is a magenta dye available from Lexmark International of Lexington, Kentucky.
[3]PROXEL GXL is biocide available from Avecia, Inc. of Wilmington, Delaware.
[4]HAMPENE Na3T is chelating agent available from HVC of Cincinnati, Ohio.
[5]SILWET is a polysiloxane surfactant available from CK Witco of Greenwich, Connecticut.

It is contemplated, and will be apparent to those skilled in the art from the foregoing specification that modifications and/or changes may be made in the embodiments of the invention. Accordingly it is expressly intended that the foregoing are only illustrative of the preferred embodiments and is not limiting thereto and that the true spirit and scope of the present invention be determined by reference to the appended claims.

What is claimed is:

1. A system for printing with an ink jet printer, the system comprising an ink jet printer containing an ink jet pen and a paper coating device for coating a print media with an effective amount of coating composition prior to printing thereon, the coating composition including from about 0.25 to about 20% by weight of a first component selected from the group consisting of polyvalent metal salt and organic acid, a second component consisting of from about 1 to about 20% by weight amine polymer, from about 0.25 to about 2.0% by weight surfactant and from about 25 to about 96% by weight glycol-based solvent having a surface tension ranging from about 25 to below about 45 dynes/cm.

2. The printing system of claim 1 wherein the amine polymer comprises a cationic amine polymer.

3. The printing system of claim 2 wherein the cationic amine polymer is a compound of the formula

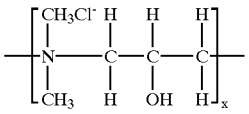

wherein x is an integer ranging from about 15 to about 2000.

4. The printing system of claim 2 wherein the cationic amine polymer is derived from dimethylamine and epichlorohydrin and has a number average molecular weight ranging from about 7,500 to about 10,000 $MW_N$.

5. The printing system of claim 2 wherein the surfactant comprises a polysiloxane surfactant.

6. The printing system of claim 5 wherein the polysiloxane surfactant is a compound having the following general structure:

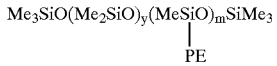

wherein: PE comprises $—CH_2CH_2CH_2O(EO)_n(PO)_oZ$, Me is a methyl group, EO is an ethyleneoxy group, PO is a 1,2-propyleneoxy group, Z is H or a lower alkyl radical y is an integer ranging from about 1 to about 10, m is an integer ranging from about 1 to about 10, n is an integer ranging from about 0 to about 5 and o is an integer ranging from about 0 to about 5.

7. The printing system of claim 1 wherein the polyvalent metal salt is selected from the group consisting of calcium chloride, magnesium chloride, calcium acetate hydrate, magnesium acetate tetrahydrate and mixtures thereof.

8. The printing system of claim 1 wherein the glycol-based solvent is selected from the group consisting of tripropylene glycol, dipropylene glycol, 1,2-propanediol and mixtures of dipropylene glycol and 1,2-propanediol having a surface tension ranging from about 25 to about 45 dynes/cm.

9. The printing system of claim 1 wherein the coating composition further comprises up to about 40% by weight deionized water.

10. The printing system of claim 1 wherein the organic acid comprises a hydroxy acid selected from the group consisting of lactic acid, glycolic acid, citric acid and malic acid.

11. The printing system of claim 10 wherein the hydroxy acid comprises citric acid.

12. The printing system of claim 1 wherein the coating composition is applied to the print media in an amount ranging from 0.08 $mg/cm^2$ to about 0.25 $mg/cm^2$.

13. A cellulosic web containing the coating composition of the printing system of claim 1.

14. A method for improving print resolution comprising applying a coating composition to a cellulosic web to provide an ink receptive coating thereon and printing on the coated web prior to drying the coating composition, wherein the coating composition contains from about 0.25 to about 20% by weight of a first component selected from the group consisting of polyvalent metal salt and organic acid, a second component consisting of from about 1 to about 20% by weight amine polymer, from about 0.25 to about 2.0% by weight surfactant and from about 25 to about 96% by weight glycol-based solvent having a surface tension ranging from about 25 to below about 45 dynes/cm.

15. The method of claim 14 wherein the amine polymer comprises a cationic amine polymer.

16. The method of claim 15 wherein the cationic amine polymer is a compound of the formula

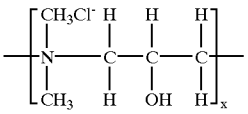

wherein x is an integer ranging from about 15 to about 2000.

17. The method of claim 15 wherein the cationic amine polymer is derived from dimethylamine and epichlorohydrin and has a number average molecular weight ranging from about 7,500 to about 10,000 $MW_N$.

18. The method of claim 15 wherein the surfactant comprises a polysiloxane surfactant.

19. The method of claim 8 wherein the polysiloxane surfactant is a compound having the following general structure:

$$Me_3SiO(Me_2SiO)_y(\underset{\underset{PE}{|}}{MeSiO})_mSiMe_3$$

wherein: PE comprises —$CH_2CH_2CH_2O(EO)_n(PO)_oZ$, Me is a methyl group, EO is an ethyleneoxy group, PO is a 1,2-propyleneoxy group, Z is H or a lower alkyl radical y is an integer ranging from about 1 to about 10, in is an integer ranging from about 1 to about 10, n is an integer ranging from about 0 to about 5 and o is an integer ranging from about 0 to about 5.

20. The method of claim 14 wherein the polyvalent metal salt is selected from the group consisting of calcium chloride, magnesium chloride, calcium acetate hydrate, magnesium acetate tetrahydrate and mixtures thereof.

21. The method of claim 14 wherein the glycol-based solvent is selected from the group consisting of tripropylene glycol, dipropylene glycol, 1,2-propanediol and mixtures of dipropylene glycol and 1,2-propanediol having a surface tension ranging from about 25 to about 45 dynes/cm.

22. The method of claim 14 wherein the coating composition further comprises up to about 40% by weight deionized water.

23. The method of claim 14 wherein the organic acid comprises a hydroxy acid selected from the group consisting of lactic acid, glycolic acid, citric acid and malic acid.

24. The method of claim 23 wherein the hydroxy acid comprises citric acid.

25. The method of claim 14 wherein the coating composition is applied to the print media in an amount ranging from about 0.08 mg/cm$^2$ to about 0.35 mg/cm$^2$.

26. A cellulosic web containing ink and a penetrant promoter coating, the coating being applied to the web prior to printing in an amount sufficient to reduce ink bleeding, promote ink drying and/or penetration of ink into the web, the promoter composition comprising from about 0.25 to about 20% by weight of a first component selected from the group consisting of polyvalent metal salt and organic acid, a second component consisting of from about 1 to about 20% by weight amine polymer, from about 0.25 to about 2.0% by weight surfactant and from about 25 to about 96% by weight glycol-based solvent having a surface tension ranging from about 25 to about 45 dynes/cm.

27. The web of claim 26 wherein the penetrant promoter coating contains from about 5 to about 30% by weight cationic amine polymer.

28. The web of claim 27 wherein the cationic amine polymer is a compound of the formula

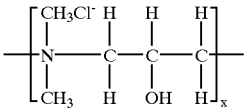

wherein x is an integer ranging from about 15 to about 2000.

29. The web of claim 27 wherein the cationic amine polymer is derived from dimethylamine and epichlorohydrin and has a number average molecular weight ranging from about 7,500 to about 10,000 $MW_N$.

30. The web of claim 26 wherein the penetrant promoter coating further comprises a polysiloxane surfactant.

31. The web of claim 30 wherein the polysiloxane surfactant is a compound having the following general structure:

$$Me_3SiO(Me_2SiO)_y(\underset{\underset{PE}{|}}{MeSiO})_mSiMe_3$$

wherein: PE comprises —$CH_2CH_2CH_2O(EO)_n(PO)_oZ$, Me is a methyl group, EO is an ethyleneoxy group, PO is a 1,2-propyleneoxy group, Z is H or a lower alkyl radical y is an integer ranging from about 1 to about 10, m is an integer ranging from about 1 to about 10, n is an integer ranging from about 0 to about 5 and o is an integer ranging from about 0 to about 5.

32. The web of claim 26 wherein the polyvalent metal salt is selected from the group consisting of calcium chloride, magnesium chloride, calcium acetate hydrate, magnesium acetate tetrahydrate and mixtures thereof.

33. The web of claim 26 wherein the ratio of ink to penetrant promoter coating ranges from about 6:1 to about 18:1 parts of ink per part of penetrant promoter coating by weight.

34. The web of claim 26 wherein the penetrant promoter coating is applied to a cellulosic web in an amount ranging from about 0.08 mg/cm$^2$ to about 0.25 mg/cm$^2$.

35. The web of claim 26 wherein the glycol-based solvent is selected from the group consisting of tripropylene glycol, dipropylene glycol, 1,2-propanediol and mixtures of dipropylene glycol and 1,2-propanediol having a surface tension ranging from about 25 to about 45 dynes/cm.

36. The web of claim 26 wherein the coating composition further comprises up to about 40% by weight deionized water.

37. The web of claim 26 wherein the organic acid comprises a hydroxy acid selected from the group consisting of lactic acid, glycolic acid, citric acid and malic acid.

38. The web of claim 37 wherein the organic acid comprises citric acid.

* * * * *

UNITED STATES PATENT AND TRADEMARK OFFICE

CERTIFICATE OF CORRECTION

PATENT NO. : 6,585,365 B1
DATED : July 1, 2003
INVENTOR(S) : David S. MacMillan

It is certified that error appears in the above-identified patent and that said Letters Patent is hereby corrected as shown below:

Column 4,
Lines 8-35, please replace with the following:

The coating formulation also preferably contains an amine polymer, preferably a cationic amine polymer. The amine polymer has a number average molecular weight ($MW_N$) ranging from about 2,000 to about 250,000, preferably from about 2,000 to about 10,000 $MW_N$, and most preferably from about 7,500 to about 10,000 $MW_N$. A particularly preferred amine polymer is a cationic amine polymer having the following structure:

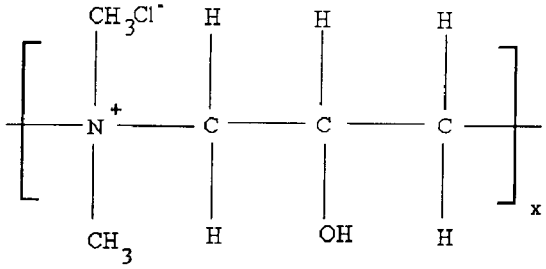

wherein x is an integer ranging from about 15 to about 2000. Such polyamines include cationic polyamines derived from dimethylamine and epichlorohydrin such as the polyamine available from Cytec Industries, Inc. of West Paterson, New Jersey under the trade name SUPERFLOC E-567. Other examples of useful amine polymers are available from Cytec Industries, Inc. under the trade names SUPERFLOC C-572 and SUPERFLOC E-4217. The coating formulation preferably contains from about 1 to about 20 percent by weight of the amine polymer.

UNITED STATES PATENT AND TRADEMARK OFFICE

CERTIFICATE OF CORRECTION

PATENT NO. : 6,585,365 B1
DATED : July 1, 2003
INVENTOR(S) : David S. MacMillan

It is certified that error appears in the above-identified patent and that said Letters Patent is hereby corrected as shown below:

Column 7,
Line 48, Claim 3, should read as follows:

The printing system of Claim 2 wherein the cationic amine polymer is a compound of the formula

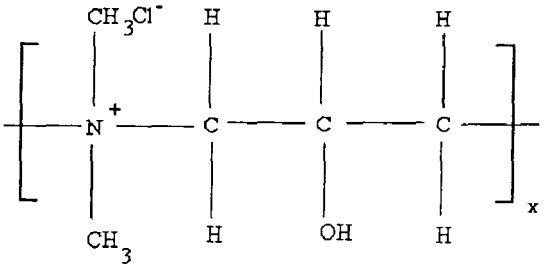

wherein x is an integer ranging from about 15 to about 2000.

Column 8,
Line 52, Claim 16, should read as follows:

The method of Claim 15 wherein the cationic amine polymer is a compound of the formula

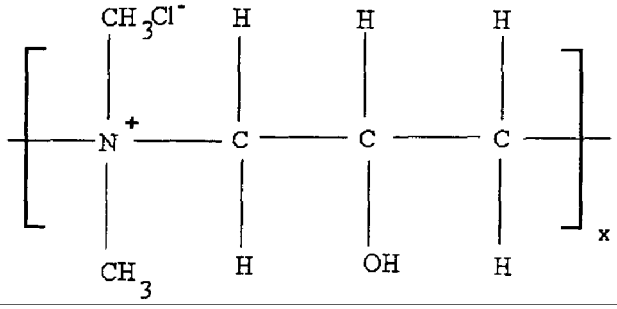

wherein x is an integer ranging from about 15 to about 2000.

UNITED STATES PATENT AND TRADEMARK OFFICE

CERTIFICATE OF CORRECTION

PATENT NO. : 6,585,365 B1
DATED : July 1, 2003
INVENTOR(S) : David S. MacMillan

It is certified that error appears in the above-identified patent and that said Letters Patent is hereby corrected as shown below:

Column 9,
Line 53, Claims 28, should read as follows:

The web of Claim 27 wherein the cationic amine polymer is a compound of the formula

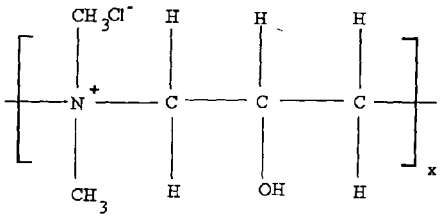

wherein x is an integer ranging form about 15 to about 2000.

Signed and Sealed this

Fourteenth Day of September, 2004

JON W. DUDAS
*Director of the United States Patent and Trademark Office*